United States Patent [19]

Adams et al.

[11] Patent Number: 4,491,503

[45] Date of Patent: Jan. 1, 1985

[54] THREADING BELT AND THREADING SYSTEM

[75] Inventors: Richard J. Adams, Rockton, Ill.; Charles A. Belding, Beloit, Wis., 4

[73] Assignee: Beloit Corporation, Beloit, Wis.

[21] Appl. No.: 428,561

[22] Filed: Sep. 30, 1982

[51] Int. Cl.[3] ..... O21F 1/36

[52] U.S. Cl. ..... 162/232; 162/193; 162/255; 162/283; 226/92

[58] Field of Search ..... 162/193, 283, 272, 232, 162/255, 274; 226/92

[56] References Cited

U.S. PATENT DOCUMENTS

| | | | |
|---|---|---|---|
| 1,991,137 | 2/1935 | Case et al. | 226/92 X |
| 2,529,184 | 11/1950 | Pearson | 226/92 X |
| 3,756,912 | 9/1973 | Rooney | 162/193 X |
| 4,111,122 | 9/1978 | Kutzner et al. | 226/92 X |

*Primary Examiner*—William Smith
*Assistant Examiner*—K. M. Hastings
*Attorney, Agent, or Firm*—Hill, Van Santen, Steadman & Simpson

[57] ABSTRACT

A threading system for threading a lead end of a web along a processing path in a papermaking machine includes an endless looped belt having a fabric base and a soft elastomeric outer surface with a transversely extending gripping slot in the surface. The slot has a round at the base and the sides of the slot are pinched together when the carrier belt extends along a straightline and with the sides separating when the carrier belt is wrapped over a roll so that the lead end of a web can be gripped in the slot for threading a web and automatically released when the sides of the slot are separated as the belt is wrapped over a roll.

12 Claims, 12 Drawing Figures

FIG. 1
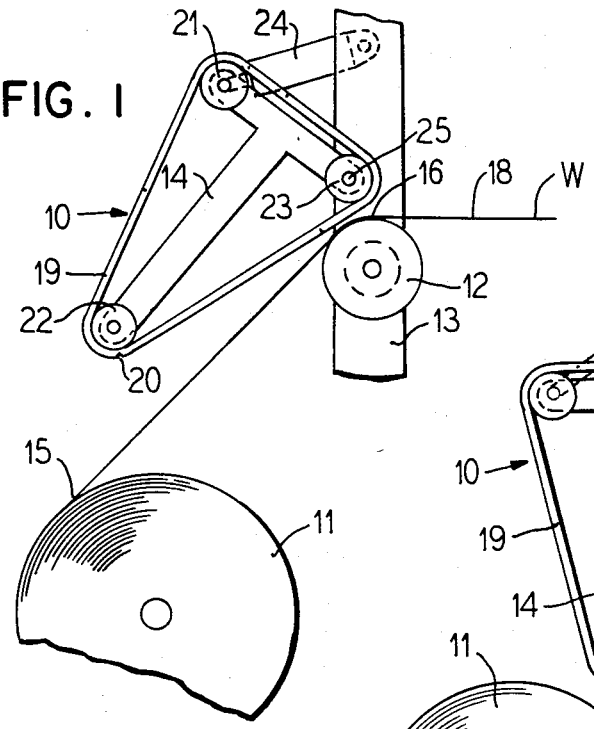
FIG. 2
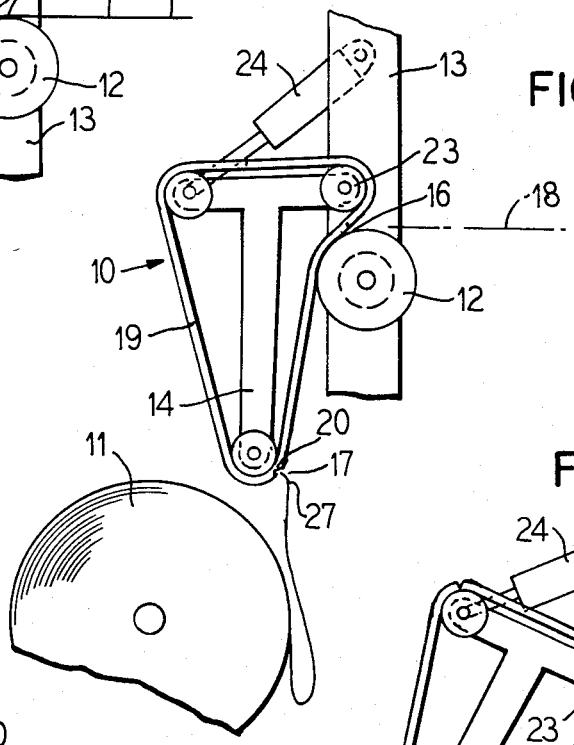
FIG. 3
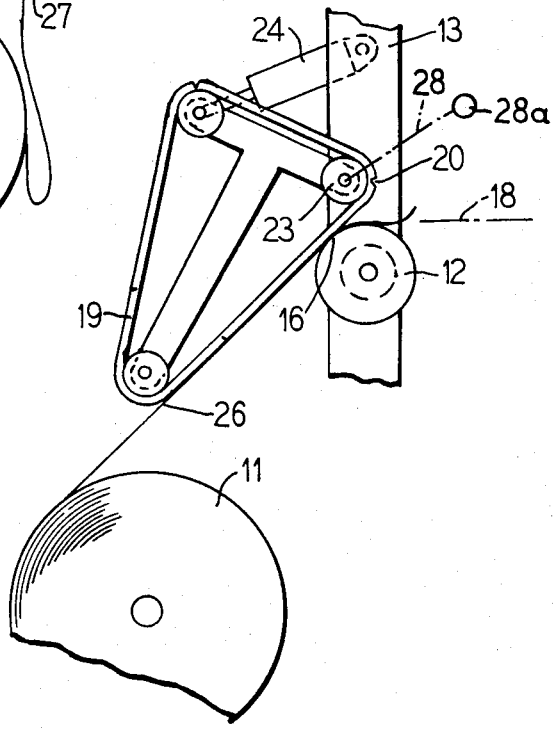
FIG. 4
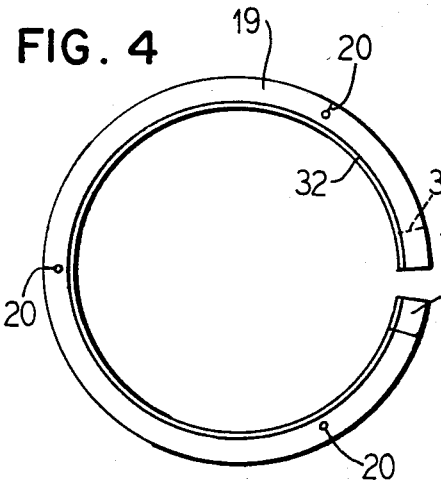
FIG. 5
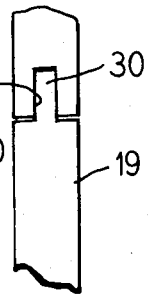
FIG. 7
FIG. 6
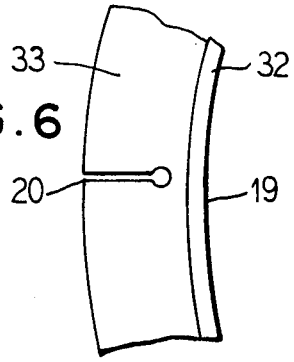
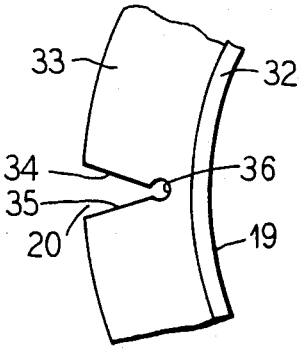
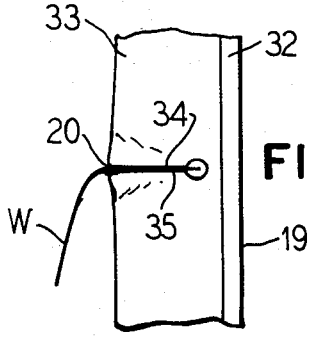
FIG. 8

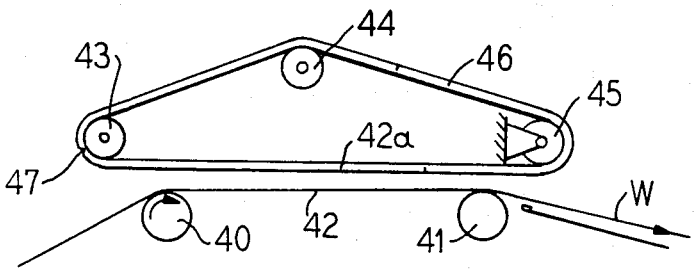
FIG. 9
FIG. 10
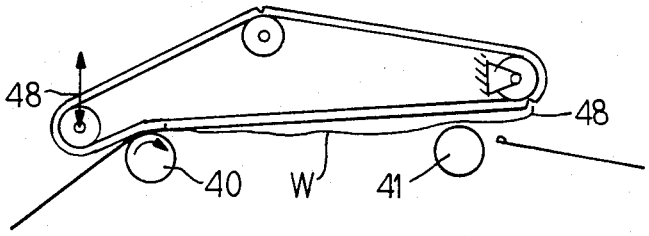
FIG. 11
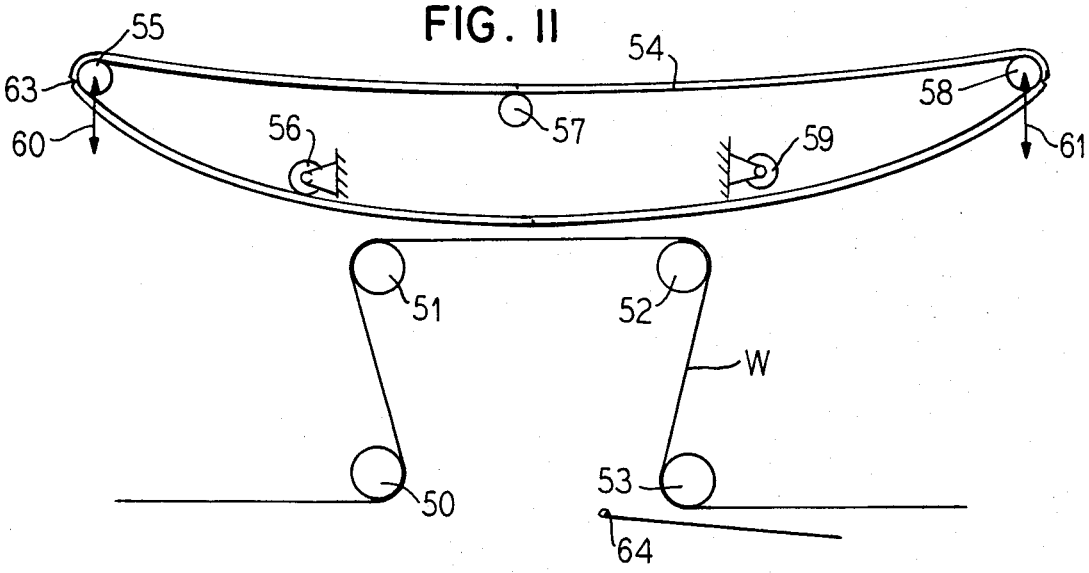
FIG. 12
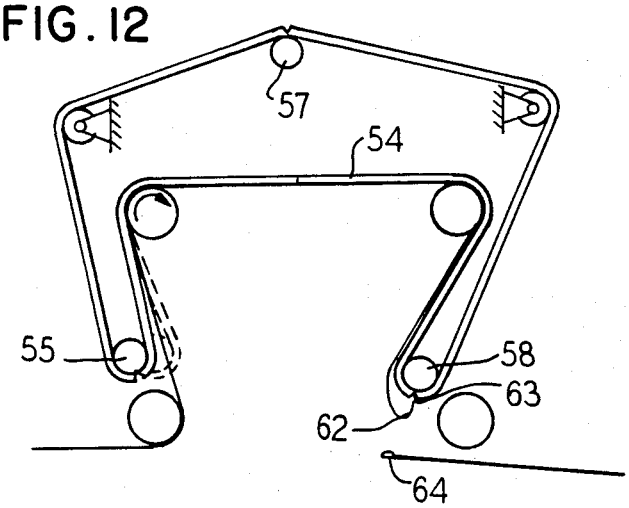

THREADING BELT AND THREADING SYSTEM

BACKGROUND OF THE INVENTION

The present invention to improvements in papermaking machines, and more particularly to an improved threading system for a winder or other paper handling area where a sheet must be threaded along a paper machine processing path.

For threading the lead end of a sheet through a processing path in a papermaking machine, the lead edge of the paper web is conventionally moved horizontally or in a downward direction along pans utilizing air showers. This method, however, will not work if the leading edge of the paper is to be transported in an upward direction. Also, difficulty is encountered when the sheet must be threaded through a tortuous path involving being carried over a number of rolls which are not arranged in a straightline. During the threading operation it is necessary to grip the lead end of a web and transport it along a processing path which may be across spaced rolls or along a belt or over the surface of a large roll. It is essential to satisfactory threading to have positive control of the lead end of the sheet so that it is not lost when making a sudden turn or carrying the sheet along an outwardly extending curve. It is also desirable that the sheet be held reasonably taut so that it does not wrinkle or flutter and so that control of the sheet is not lost.

An example of the need for a threading device to carry the lead end of the sheet is in a winder. The device which is used for threading the lead end of the sheet should be of a construction so that it does not get in the way of normal operating mechanisms and should be of a construction such that it can be brought into an existing papermaking machine without requiring alteration of the machine and so that the machine can be designed without modification or consideration as to providing space for the threading device. The threading device should be such that it can be quickly and easily brought into play when threading is required and moved out of the way as soon as the threading is completed and the machine is brought into normal operation. Devices heretofore available have not been readily capable of carrying a web through all types of paths including upwardly extending paths and have not had the flexibility and capability of handling situations as above described.

It is accordingly an object of the present invention to provide an improved threading mechanism for carrying the lead end of a sheet through a path in a papermaking machine which avoids disadvantages encountered in systems heretofore available. A further object of the invention is to provide an improved threading device which is relatively inexpensive and has a long operating life not requiring repair or maintenance.

A further object of the invention is to provide a sheet threading device which makes it possible to quickly and surely grip the lead end of a traveling sheet and which automatically releases the sheet after it has completed threading it through the desired path.

Other objects, advantages and features, as well as equivalent structures which are intended to be covered herein, will become more apparent with the teaching of the principles of the invention in connection with the disclosure of the preferred embodiments in the specification, claims and drawings, in which:

DRAWINGS

FIG. 1 is an elevational view, shown in somewhat schematic form, of a sheet threading device which is constructed and operates in accordance with the principles of the present invention;

FIG. 2 is another view similar to FIG. 1 illustrating the device at a different operational position for receiving the lead end of the sheet;

FIG. 3 is a view similar to FIGS. 1 and 2 and illustrating the sheet being automatically released after it has been threaded;

FIG. 4 is a detailed elevational view of a sheet threading belt constructed in accordance with the invention;

FIG. 5 is an enlarged detail view showing an arrangement for connecting the ends of a belt;

FIGS. 6, 7 and 8 are enlarged fragmentary views showing sequentially the relative positions of the sides of the sheet gripping slot;

FIGS. 9 and 10 illustrate another form of the threading belt with the belt being positioned in its nonoperative location in FIG. 9 and being positioned in its operative threading position in FIG. 10; and FIGS. 11 and 12 are schematic sequential views illustrating another form of sheet threading device with the device in nonoperative position in FIG. 11 and being brought into operative threading position in FIG. 12.

DESCRIPTION

FIGS. 1 through 3 illustrate sequentially the operation of a sheet threading device in accordance with the principles of the present invention. FIG. 1 illustrates a papermaking machine mechanism such as a winder in operation wherein a web or sheet W is led off of an unwinding roll 11 and the web travels from the roll 11 shown at location 15 up over a roll 12 to continue on a path 18. For threading at the beginning of a run, the lead end of the web is picked up from the location 15 and carried up onto the roll 12 at location 16 so that it can continue through the machine. From location 16 it is carried across a further open dryer onto a belt along path 18 by other means.

The threading mechanism is shown mounted on a frame 13 which also carries the paper web roll 12. The threading device shown generally at 10 includes a frame 14 pivoted about a pivot point 25 on the frame 13. A threading device 10 includes a looped endless belt 19 which is supported on rollers 21, 22 and 23 supported on the threading device frame 14. A hydraulic cylinder 24 is connected between the paper machine frame 13 and the threading mechanism frame 14 so as to be able to pivot the frame 14 from a nonoperative position as shown in FIG. 1 to an operative threading position as shown in FIGS. 2 and 3.

The threading device 10 features a looped endless belt 19 with an automatically opening transversely extending gripper slot 20 in the outer surface of the belt 19.

The extent from points 15 to 16 on the papermaking machine define a paper machine processing path through which the lead end of the traveling web is to be carried. When the threading device is brought down into operative position, in the position shown in FIG. 3, it carries the lead end of the web from location 26 to location 16 along the threading path which is substantially parallel to the paper machine processing path and as shown, is co-extensive therewith.

In the beginning of operation for threading the web, the frame 14 of the threading machine is brought down into the postion of FIG. 2, and the lead end 27 of the web W is nipped or pinched in the slot 20 in the belt 19 at location 17. The belt 19 is then driven forwardly by a drive mechanism driving one of the rolls and schematically a drive mechanism is shown at 28 operated by a switch 28*a* driving the roll 23. For placing the sheet end in the slot 20, the drive is stopped, then moved ahead to straighten the belt at the location of the slot to pinch the sheet. The lead end 27 of the web is then carried upwardly to location 16 up over the roll 12. As the belt is wrapped so that the slot 20 passes over the roll 23, it is automatically released to be carried along its path 18. This may be defined by another carrying belt in the papermaking machine or air jet or similar arrangement.

When the web has been threaded, the threading device of frame 14 can be pivoted back up into the position of FIG. 1 out of the way where it is ready for utilization in another threading operation.

As illustrated in FIGS. 4 and 5, the belt 19 may be formed as a straight member with the ends dove-tailed so as to be able to form a looped belt. In a typial papermaking machine installation, a belt of 4" to 6" wide will be preferred. At one end of the belt is provided a tongue 30 and on the mating end a groove 31 for receiving the tongue, and the two can be cemented or suitably attached to form the completed looped belt. A plurality of slots such as 20 may be provided opening outwardly. Preferably, the belt is formed with a fabric base 32 which may be of an nonextensible material such as a cord embedded rubber. The outer layer of the belt 19 is formed of a relatively soft elastomeric material and a soft polyurethane is preferred. It is necessary only to provide the soft elastomeric material at the edges of the slot, but for convenience of manufacture and convenience of running the belt over the rollers, the entire outer layer of the belt is formed of the soft material.

As illustrated in FIGS. 6 through 8, when the belt 33 is curved over a smaller roller such as the rollers of FIG. 1, the sides 34 and 35, FIG. 7, will separate so that the lead end of a web can be inserted therein. As the belt flattens toward a planar form, the sides of the groove or slot 20 begin to move together as illustrated at FIG. 6. When the belt 33 is straight, the sides 34 and 35 pinch together with a deformation of the elastomeric material at the sides of the groove to firmly frictionally hold the lead end of the web W. In manufacture, the belt 33 is preferably cast in an arcuate form as shown in FIG. 6 so that when it is flattened, there is an excess of material on both sides of the groove 20 to create the pinching effect.

At the base of the groove 20 is a round 36 which functions to prevent the groove from splitting at the base and separating the elastomeric material. Any round of small curvature is satisfactory leaving the jaws or gripping surfaces 34 and 35 toward the outer surface of the belt. The elastomeric material is suitably bonded to the fabric base 32 to provide a long wearing monolithic belt.

FIGS. 9 and 10 illustrate an arrangement wherein the belt 46 is utilized to thread the lead end of a web W over a straight paper machine processing path 42 as defined between rolls 40 and 41. The threading belt 46 is supported on fixed rolls 44 and 45 and a vertically movable roll 43. In FIG. 9 the belt 46 is in nonoperative position. When a threading operation is to begin, the lead end of the web is inserted into the slot 47 as it opens naturally when passing over the relatively sharp radius of the roll 43. When the slot 47 moves down to the straightline path of the threading path 42*a*, the sides of the slot will close and pinch the web. The roller 43 is brought down to the position shown in FIG. 10 where the belt slightly wraps the machine roll 40. The lead end 48 of the web is carried along the machine path 42 from roll 40 to roll 41, and when the belt travels over the relatively sharp radius of the roll 45, the sides of the slot automatically separate to drop the lead end 48 of the web W.

In FIG. 11 a threading belt 54 is illustrated utilized for threading a web over a sinuous path. The papermaking machine path is defined by paper rolls 50, 51, 52 and 53 with the web W shown in its normal path of travel. When a lead end 62 of a web is to be threaded into the machine, the end rollers 55 and 58 carrying the belt 54 are brought downwardly in the direction indicated by the arrowed lines 60 and 61 into the position of FIG. 12. The belt 54 is carried on nonmovable rotary rollers 56, 57 and 59 which remain in place. As a slot 63 in the belt passes over the sharp radius of roller 55, the lead end 62 of a web is pinched in the slot 63 and the web is carried up over the paper processing path. When the slot reaches the position of the threading roller 58 as shown in FIG. 12, the slot opens to drop the lead end, and suitable means such as an air jet will pick up the lead end 62 to carry it further through the papermaking machine. The threading belt 54 then can be brought up to its nonoperative position as illustrated in FIG. 11.

With reference to FIG. 6, in operation when the belt passes over the radius of a roller which is relatively small, the sides 34 and 35 of the slot 20 will open as shown in FIG. 7. The lead end of the web W, FIG. 8, will then be placed in the slot so that when the belt straightens, it will be pinched in the slot. This will permit the web end to be carried forward with the belt until it again passes over a small radius roller to open the slot and drop the lead end having carried it through the paper machine path.

Thus, it will be seen that we have provided an improved web threading system which obtains a simplified, inexpensive reliable web threading mechanism.

We claim as our invention:

1. A threading system for threading a traveling web comprising in combination:

means defining a paper machine processing path through which a lead end of a traveling web is to be carried;

an endless looped belt extending along a threading path essentially parallel to said processing path and having in an outer surface facing the processing path an automatically opening, transversely extending, gripping slot with sides pressed together for gripping a web when extending in a straight run and separated to release the web when curved over an arcuate path; and means training said belt along the threading path over a first roller at an upstream point in the threading path and a second roller at a downstream point along the threading path so that the web is gripped by said slot at the first roller to be carried along the processing path and automatically released at the second roller.

2. A threading system for threading a traveling web constructed in accordance with claim 1:

wherein the material of the belt adjacent the slot is made of a soft elastomeric substance.

3. A threading system for threading a traveling web constructed in accordance with claim 2:

wherein said substance is a soft polyurethane.

4. A threading system for threading a traveling web constructed in accordance with claim 2:

wherein the inner surface of the belt is formed of a nonextensible fabric backing.

5. A threading system for threading a traveling web constructed in accordance with claim 1:

wherein said rollers are carried on a frame movable from a first position wherein the belt extends along said threading path and a second position away from said threading path.

6. A threading system for threading a traveling web constructed in accordance with claim 1:

wherein said processing path includes a third roller, said third roller being a paper machine roller and the outer surface of said belt is wrapped over the third roller along the threading path.

7. A threading system for threading a traveling web constructed in accordance with claim 1:

wherein said processing path includes first and second paper machine rolls; and a frame supporting said first and second belt rollers and moveable from a first position wherein the belt is wrapped over the paper machine rolls and a second position wherein the belt is removed from the papermaking machine rolls.

8. A threading device for threading a traveling web comprising in combination:

an elongate endless carrier belt having a transversely extending gripping slot opening from its outer surface with sides together in gripping relationship when the belt is extended in a planar path and the sides being separated in a release relationship when the belt is bent toward its inner surface.

means defining a paper machine processing path through which the lead end of a traveling web is to be carried; and 9. A threading device for threading a traveling web constructed in accordance with claim 8:

wherein the material at said slot sides compresses and deforms when said sides are in gripping relationship.

10. A threading device for threading a traveling web constructed in accordance with claim 8:

including a round at the base of said slot with the sides of said round remaining separated when the sides of the slot are in gripping relationship.

11. A threading device for threading a traveling web constructed in accordance with claim 8:

wherein the material at the sides of the slot is formed of a soft elastomeric material.

12. A threading device for threading a traveling web constructed in accordance with claim 8:

wherein the outer surface of the belt for the depth of the slot is formed of a soft elastomeric material mounted on a nonexpansible base material.

* * * * *

UNITED STATES PATENT AND TRADEMARK OFFICE

CERTIFICATE OF CORRECTION

PATENT NO. : 4,491,503

DATED : January 1, 1985

INVENTOR(S) : Richard J. Adams & Charles A. Belding

It is certified that error appears in the above–identified patent and that said Letters Patent are hereby corrected as shown below:

In claim 8, following the preamble, the paragraphs beginning on lines 1 and 7 of column 6 are reversed, and the claim should read as follows:

--means defining a paper machine processing path through which the lead end of a traveling web is to be carried; and an elongate endless carrier belt having a transversely extending gripping slot opening from its outer surface with sides together in gripping relationship when the belt is extended in a planar path and the sides being separated in a release relationship when the belt is bent toward its inner surface.--

Signed and Sealed this

*Twenty-eighth* Day of *May 1985*

[SEAL]

*Attest:*

DONALD J. QUIGG

*Attesting Officer* *Acting Commissioner of Patents and Trademarks*